US009572379B2

(12) United States Patent
Jones

(10) Patent No.: US 9,572,379 B2
(45) Date of Patent: Feb. 21, 2017

(54) SWIMSUIT WITH ENHANCED BUTTOCK PORTION

(76) Inventor: Karen E. Jones, Miami, FL (US)

( * ) Notice: Subject to any disclaimer, the term of this patent is extended or adjusted under 35 U.S.C. 154(b) by 0 days.

(21) Appl. No.: 14/007,067

(22) PCT Filed: Mar. 20, 2012

(86) PCT No.: PCT/US2012/029799

§ 371 (c)(1),
(2), (4) Date: Nov. 18, 2013

(87) PCT Pub. No.: WO2012/134886

PCT Pub. Date: Oct. 4, 2012

(65) Prior Publication Data

US 2014/0080381 A1 Mar. 20, 2014

Related U.S. Application Data

(60) Provisional application No. 61/468,735, filed on Mar. 29, 2011.

(51) Int. Cl.

| | |
|---|---|
| ***A41D 7/00*** | (2006.01) |
| *A41D 27/26* | (2006.01) |
| *A41D 27/08* | (2006.01) |

(52) U.S. Cl.

CPC ..... *A41D 7/005* (2013.01); *A41D 7/00* (2013.01); *A41D 27/08* (2013.01); *A41D 27/26* (2013.01);

(Continued)

(58) Field of Classification Search

CPC ..... A41D 13/015; A41D 1/06

(Continued)

(56) References Cited

U.S. PATENT DOCUMENTS

D157,203 S * 2/1950 Piecka ..... D2/733
D158,028 S * 4/1950 Turner ..... D2/733

(Continued)

FOREIGN PATENT DOCUMENTS

JP 2001303414 A 10/2001
JP 2003113514 A 4/2003

(Continued)

OTHER PUBLICATIONS

International Search Report and Written Opinion, Issued by the Korean Intellectual Property Office on Oct. 8, 2012.

(Continued)

*Primary Examiner* — Gloria Hale
(74) *Attorney, Agent, or Firm* — Ernest Lipscomb, III; Barnwell Whaley Patterson & Helms

(57) ABSTRACT

A swimsuit having a swimsuit bottom having a rear portion, a front portion, a pair of leg openings and a waist band for encasing the lower portion of a wearer's torso. The swimsuit bottom is form-fitting and made of elastic material of stretchable, resilient synthetic or synthetic blend fabric. The swimsuit bottom has a pair of pockets formed in the interior of the swimsuit bottom of the buttock area of the rear portion sized to accommodate a pair of pads designed for insertion into each of the pockets for enhancing the buttock of the wearer. The pads may be of different sizes and shapes to accommodate different body sizes and shapes in order to provide the desired enhancement. Decorative adornment such as ruffles or lacy trim is added on the swimsuit bottom to hide the pads.

8 Claims, 2 Drawing Sheets

(52) U.S. Cl.
CPC ..... *A41D 2300/20* (2013.01); *A41D 2400/38* (2013.01)

(58) Field of Classification Search
USPC 2/67, 400–406; 450/94, 96, 98–99; D2/731, 733, 734–738, 791
See application file for complete search history.

(56) References Cited

U.S. PATENT DOCUMENTS

| | | | | | |
|---|---|---|---|---|---|
| D160,221 | S | * | 9/1950 | Sinsley | D2/712 |
| D184,612 | S | * | 3/1959 | Emmet | D2/712 |
| D193,131 | S | * | 7/1962 | Owen | D24/126 |
| 3,704,469 | A | * | 12/1972 | Levy | 2/67 |
| 3,771,172 | A | * | 11/1973 | Barg | 2/67 |
| 4,028,740 | A | * | 6/1977 | Luerken | 2/67 |
| 5,103,505 | A | * | 4/1992 | Llorens | A41D 13/0537 2/228 |
| 5,586,340 | A | * | 12/1996 | Russo | 2/67 |
| 5,649,328 | A | * | 7/1997 | Martin | A41D 1/08 2/227 |
| 5,918,310 | A | * | 7/1999 | Farahany | A41D 13/015 2/228 |
| 6,182,297 | B1 | * | 2/2001 | Duren | A41B 9/001 2/228 |
| 7,704,120 | B2 | * | 4/2010 | Chen | A41B 9/001 2/466 |
| 2010/0064409 | A1 | * | 3/2010 | Buckley | A41B 9/001 2/67 |

FOREIGN PATENT DOCUMENTS

| | | | |
|---|---|---|---|
| KR | 200297801 | Y1 | 12/2002 |
| KR | 200389565 | Y1 | 7/2005 |
| KR | 200454019 | Y1 | 6/2011 |

OTHER PUBLICATIONS

Supplementary European Search Report dated Oct. 31, 2014 in connection with European Patent Application No. EP12763103, 6 pages.

* cited by examiner

SWIMSUIT WITH ENHANCED BUTTOCK PORTION

CROSS-REFERENCE TO RELATED APPLICATIONS

The contents of PCT Application No. PCT/US2012/29799 filed Mar. 20, 2012, which claimed priority to Provisional Application U.S. Ser. No. 61/468,735 filed Mar. 29, 2011, on which the present application is based and benefit claimed under 35 U.S.C. §119(e), is herein incorporated by reference.

BACKGROUND OF THE INVENTION

1. Field of the Invention

The present invention is a swimsuit or bathing suit having a bottom with padding that gives the illusion of an enhanced buttock region. More particularly, this invention relates to a buttock-enhancing swimsuit that provides the ability to change the shape and the looks of the wearer's buttock region, and addresses the visibility of padding inside the garment by an outside observer.

2. Description of Related Art

For a number of years both women and men have become more concerned with their appearance and thus greater emphasis has been placed on the desire to have clothing assist the wearer in having an aesthetically pleasing appearance. In response, designers have concentrated on developing garments which enable the wearer to have greater freedom of expression, versatility of activity with maximum ease, and emphasizing the wearer's physical attributes. This is especially the situation with swimwear.

Designing aesthetically pleasing swimwear that meets these criteria is especially difficult in situations where straps, seams, ridges and the like are visible to others. Although there are swimsuits and undergarments that have body enhancing pads, the lack of buttock-enhancing swimsuits available is attributed in part to the difficulty in designing a swimsuit bottom with padding that remains hidden and undetectable under wet or dry fabric. Another factor hindering the ability to enhance the buttock portion of a swimsuit wearer is that a swimsuit designer would like to have a single swimsuit size for different buttock shapes and sizes. However, the general public has a variety of such shapes and sizes making the designer's design for such swimsuits more difficult.

When a designer is considering using padded underwear that is hidden inside clothing, one can assume that the wearer would not be concerned because the padding is not visible by another person. Such designs, while desirable by the wearer do not help a designer in designing swimwear. It is desirable that the body-enhancing pads must not be detectable by an observer whether the swimsuit is wet or dry. In presently available swim suits, when the swimsuit fabric covering the pads is wet, the existence of the pads is quite obvious.

The use of pads is known for undergarments and swimsuits as a device for shaping and flattering the appearance of the wearer. Another type of shaping garment has a cover panel coupled to an undergarment to provide support and shaping to the body of the wearer. Also known is an outer garment and inner liner where the inner liner has a stitch pattern to provide support of areas of the body to accentuate features of the wearer. Additional prior art includes swimsuits having buttock padding members but these swimsuits do not address the practical and detrimental problem that the pads in a bathing suit are visible in public when the swimsuit fabric is dry, and even more so when it is wet.

Despite prior efforts to produce a comfortable, aesthetically pleasing and practical swimsuit having padding that gives the illusion of an enhanced contour in the buttock region, there remains a desire to produce a swimsuit that has certain improved features allowing for the wearer to adjust the size and shape of the buttock and not be visible when the swimsuit fabric is either dry or wet.

SUMMARY OF THE INVENTION

It is therefore the general object of the present invention to provide a new and improved form-fitting swimsuit, the bottom of which enhances the buttock region of the wearer.

Another object of the present invention is to provide a swimsuit or swimsuit bottom enhancing the buttocks of the wearer, the swimsuit bottom having a pair of pockets sized to accommodate a pair of buttock-enhancing pads, a combination of pad shape, pad material, pad size and bathing suit design concealing the pads inside the swimsuit bottom.

Still another object of the present invention is to provide a swimsuit bottom that gives the illusion of a bigger or fuller contour in the buttock area of the wearer regardless of whether or not the fabric of the swimsuit bottom is wet or dry.

Yet another object of the present invention is to provide a swimsuit bottom giving the illusion that the wearer has an enhanced buttock portion, and that the shape and size of the buttock portion can be changed to suit the wearer.

An even further object of the present invention is to provide an enhanced swimsuit bottom that permits a full range of activities that do not make obvious the fact that the swimsuit bottom is padded to enhance the buttock area, and has decorative adornment on the exterior of the swimsuit bottom that serves to hide the edges of the buttock enhancing pads.

The present invention meets the objects presented above by providing a form fitting swimsuit having a swimsuit bottom that has pockets in the rear portion of the bottom that are capable of holding a pair of pads that enhance the buttock area of the wearer.

The swimsuit includes a swimsuit bottom having a rear portion, a front portion, a pair of leg openings and a waist band for encasing the lower portion of a wearer's torso. The swimsuit bottom is form-fitting, flexible and made of elastic material of stretchable, resilient synthetic or synthetic blend fabric. The fabric may include, for example, nylon, polyester, spandex, and blends thereof. The swimsuit bottom has a pair of pockets formed in the interior of the swimsuit bottom of the buttock area of the rear portion sized to accommodate a pair of pads designed for insertion into each of the pockets for enhancing the buttock of the wearer. The pads are inserted into the pockets of the swimsuit bottom. The pockets may be sewn into the swimsuit bottom along a middle seam provided between the right and left buttock. The pockets are formed inside the swimsuit bottom with one pocket being on each side of the middle seam. The pads may be of different sizes and shapes to accommodate different body sizes and shapes in order to provide the desired enhancement. In a preferred embodiment, the pad pockets are shaped to hold the pads in place while swimming, walking, sitting and standing without an observer being able to detect the presence of the pads. Decorative adornment such as ruffles or lacy trim is added along the bottom of the rear portion of the swimsuit bottom.

Other objects, features and advantages of the present invention will become apparent from the following detailed description of the invention taken in conjunction with the accompanying drawings.

BRIEF DESCRIPTION OF THE DRAWINGS

Having described the invention in general terms, reference will now be made to the accompanying drawings, which are not necessarily drawn to scale, and wherein.

DESCRIPTION OF THE PREFERRED EMBODIMENT(S)

The present invention now will be described more fully hereinafter with reference to the accompanying drawings, in which preferred embodiments of the invention are shown. This invention may, however, be embodied in many different forms and should not be construed as limited to the embodiments set forth herein; rather these embodiments are provided so that this disclosure will be thorough and complete and will fully convey the scope of the invention to those skilled in the art. Like numbers refer to the elements throughout.

Figure 1:
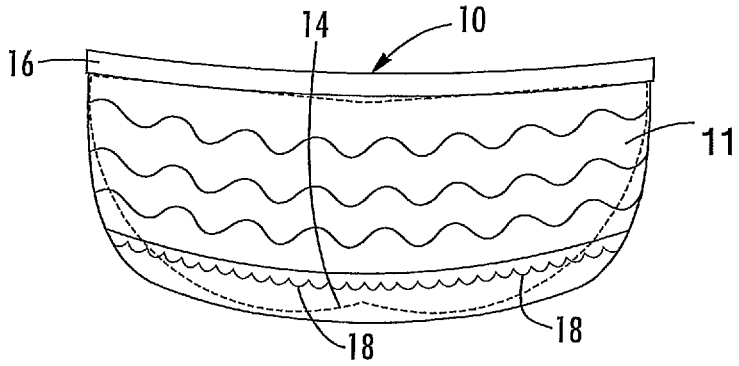
FIG. 1 is a back view of a preferred embodiment of the swimsuit bottom of the present invention showing the rear portion and illustrating the decorative adornment and showing in phantom outline the buttock area of the wearer.
Figure 2:
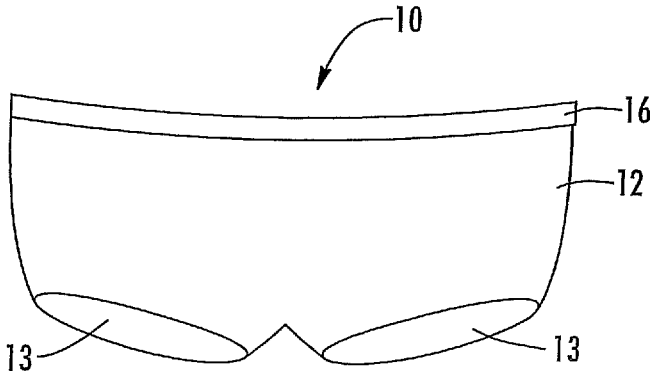
FIG. 2 is a front view of a preferred embodiment of the invention illustrating the swimsuit bottom showing the front portion.

Referring now to FIGS. 1 and 2, there is shown a swimsuit bottom 10 according to the present invention. The swimsuit bottom 10 has a rear portion 11, a front portion 12, a pair of leg openings 13 and a waist band 16 for encasing the lower portion of a wear's torso. The swimsuit bottom 10 is form-fitting and flexible, elastic material made of stretchable, resilient synthetic or synthetic blend fabric. The fabric may include, for example, nylon, polyester, spandex, and blends thereof. The front portion 12 and the rear portion 11 are coupled together and to the waist band 16 and define a pair of leg openings 13.

With reference to FIG. 1, the rear portion 11 of the swimsuit bottom 10 there is shown in phantom outline 14 the buttock area of the wearer. Decorative adornment 18, such as ruffles, lace or other decorative trim, is added in one or more rows extending along the bottom of the rear portion 11 of the bathing suit bottom. The decorative trim is preferably started at approximately 0.3 to about 0.6 cm from the bottom seam of the garment and in the embodiment of FIG. 1 extends in rows across the rear portion 11 to hide the line of the buttock-enhancing pads 40, 42.

Figure 3:
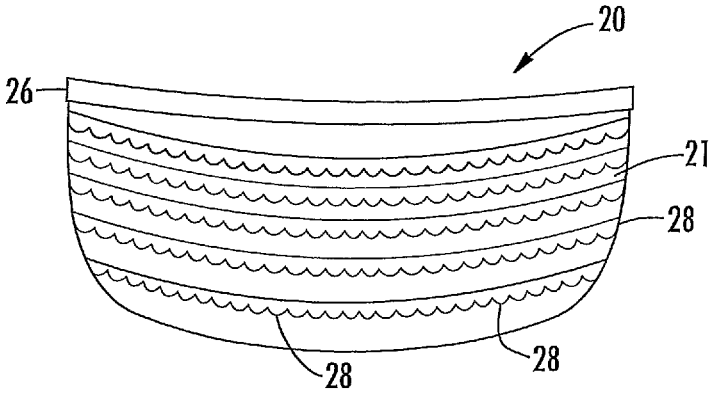
FIG. 3 is a back view of a second preferred embodiment of the invention illustrating the swimsuit bottom and showing decorative adornment adapted to prevent the appearance of lines caused by the edges of the pads.
Figure 4:
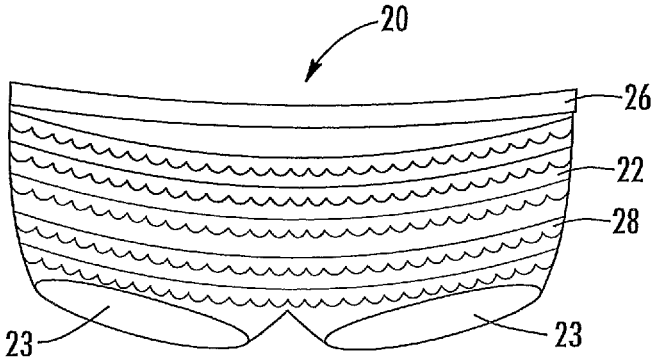
FIG. 4 is a front view of the second preferred embodiment of the invention illustrating the swimsuit bottom showing decorative adornment on the front portion of the swimsuit bottom.

FIGS. 3 and 4 show another embodiment of the swimsuit bottom 20 of the present invention comprising a rear portion 21, a front portion 22, leg openings 23 and a waist band 26. The embodiment of FIGS. 3 and 4 also include decorative adornment 28 on the front portion 22 of the swimsuit bottom as well as the rear portion 21.

Figure 5:
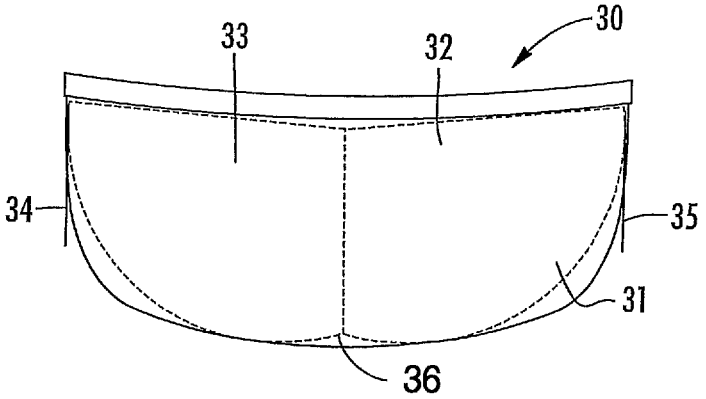
FIG. 5 is a back cutaway view illustrating the positioning of the buttock enhancing pads in the pockets of the rear portion of the swimsuit bottom.
Figure 6:
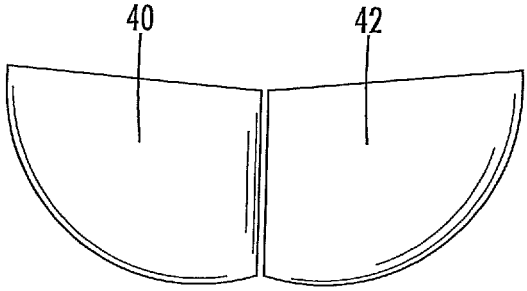
FIG. 6 shows an example of a pair of buttock-enhancing pads illustrating the right and left pads.

Turning now to FIG. 5, there is shown a cut away view of the rear portion 31 of swimsuit bottom 30 having a pair of pockets 32, 33 in the buttock area of the swimsuit bottom to accommodate a pair of buttock-enhancing pads 40, 42, such as those shown in FIG. 6. A middle seam 36 is provided from the waist to the crotch in the rear portion 11 to which the pockets 32, 33 may be formed. In this example, the buttock-enhancing pads 40, 42 are inserted into the pockets 32, 33 through slits 34, 35 in the swimsuit bottom.

Figure 7:
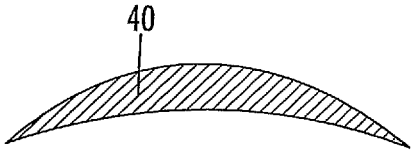
FIG. 7 is a cross section of one of the buttock-enhancing pads shown in FIG. 6.

There is shown in FIG. 6 an example of a buttock-enhancing pads, e.g., left side pad 40 and a right side pad 42. In FIG. 7 there is shown a cross-section of buttock-enhancing pad 40. It should be understood that one of the advantages of the present invention is that pads of different sizes and shapes may be used depending upon the desired look of the wearer. Because of the construction of the swimsuit bottom 10 the buttock-enhancing pads may be easily interchanged. In a preferred embodiment the pad pockets 32, 33 are shaped to hold the pads in place while swimming, walking, sitting and standing with an observer not detecting the presence of the buttock pads. The pads 40, 42 may be made of material such as foam or silicone that mimic the shape of each cheek from middle of buttocks sideways out to hip.

The pads 40, 42 are preferably formed in the same shape as the swimsuit bottom's pockets 32, 33 to prevent the appearance of lines caused by the edges of the pads, consequently concealing the presence of padding. Another benefit of this shape of pad is a more realistic enhancement, especially for women with wide hips who need gradual padding from the crown of the cheek out to the hip for a more natural and realistic increase in buttock size and shape.

Whether the swimsuit bottom is a bikini bottom, a one-piece bathing suit or a men's swim trunk with pads, the pads are made of silicone or water-resistant foam. The pad pockets are in the form of the size and shape of the pads which will hold the pads in place while swimming, walking, sitting, standing, etc. Adornment or decoration along the bottom of the rear of the bathing suit bottom is used to hide the line of the pads when the bathing suit gets wet. Therefore, a key advantage of this invention is the combination of pad shape, pad material and bathing suit design that will aid in concealing the buttock enhancing pads inside the swimsuit bottom.

Many modifications and other embodiments of the inventions set forth herein will come to mind to one skilled in the art to which these inventions pertain, having the benefit of the teachings presented in the foregoing descriptions. Therefore, it is to be understood that the inventions are not to be limited to the specific embodiments disclosed, and that modifications and other embodiments are intended to be included within the scope of the appended claims. Although specific terms are employed herein, they are used in a generic and descriptive sense only, and not for purposes of limitation.

What is claimed is:

1. A swimsuit bottom for enhancing the buttock of the wearer comprising:

a form-fitting swimsuit bottom having a rear portion, a front portion and a pair of leg openings;

said rear portion includes a pair of pockets, each pocket for receiving a buttock-enhancing pad;

said pair of pockets being formed on one side of each of said pockets by a fabric portion and another side of each pocket being formed by the fabric of said swimsuit rear portion;

a pair of buttock-enhancing pads each one of said pair of pads sized and shaped for insertion into each one of said pockets, said pads being easily removable from said pockets and said rear portion having decorative adornment attached along the bottom thereof in at least one row extending across said rear portion so as to conceal the presence of said pads.

2. The swimsuit bottom according to claim 1 further comprising a torso encircling waist band.

3. The swimsuit bottom according to claim 1 wherein said swimsuit comprises a flexible and elastic fabric.

4. The swimsuit bottom according to claim 1 wherein said swimsuit bottom comprises a fabric selected from the group consisting of nylon, polyester, spandex, and blends thereof.

5. The swimsuit bottom according to claim 1 wherein said buttock-enhancing pads are made of foam or silicone.

6. The swimsuit bottom according to claim 1 wherein said decorative adornment surrounds said swimsuit.

7. A swimsuit bottom for enhancing the buttock of the wearer comprising:

a form-fitting swimsuit bottom having a rear portion, a front portion, a pair of leg openings and a waist band;

said rear portion includes a pair of pockets each pocket for receiving a buttock-enhancing pad;

said pair of pockets being formed on one side of each of said pockets by a fabric portion and another side of each pocket being formed by the fabric of said swimsuit rear portion;

said swimsuit bottom comprising a flexible and elastic fabric being adapted for conforming to the wearer's lower torso and selected from the group consisting of nylon, polyester, spandex, and blends thereof;

a pair of buttock-enhancing pads each one of said pair of pads being made of foam or silicone, and sized and shaped for insertion into each one of said pockets, said pads being easily removable from said pockets and said rear portion having decorative adornment attached along the bottom thereof in at least one row extending across said rear portion so as to conceal the presence of said pads.

8. The swimsuit bottom according to claim 7 wherein said decorative adornment surrounds said swimsuit bottom.

* * * * *